United States Patent [19]

Kretchmar

[11] Patent Number: 4,544,861

[45] Date of Patent: Oct. 1, 1985

[54] RECTIFIER HOUSING FOR USE WITH LIGHT BULBS

[75] Inventor: Roy Kretchmar, Boca Raton, Fla.

[73] Assignee: Certified Energy Systems, Inc., Boca Raton, Fla.

[21] Appl. No.: 483,897

[22] Filed: Apr. 11, 1983

[51] Int. Cl.[4] ..... H05B 37/00

[52] U.S. Cl. ..... 315/200 R; 338/219

[58] Field of Search ..... 315/200 R; 338/219

[56] References Cited

U.S. PATENT DOCUMENTS

| | | | |
|---|---|---|---|
| 2,484,596 | 10/1949 | Waltz | 315/200 |
| 3,028,525 | 4/1962 | Morton | 315/272 |
| 3,062,986 | 11/1962 | Fritz et al. | 315/200 |
| 3,215,891 | 11/1965 | Fritz et al. | 315/50 |
| 3,325,762 | 6/1967 | Rosenblatt | 338/219 |
| 3,333,224 | 7/1967 | Rosenblatt | 338/219 |
| 3,818,263 | 6/1974 | Belko | 338/219 |
| 3,823,339 | 7/1974 | Borneman et al. | 315/69 |
| 4,229,680 | 10/1980 | Berlin et al. | 315/200 R |
| 4,435,671 | 3/1984 | Wouk | 315/200 |
| 4,438,344 | 3/1984 | Albert et al. | 315/362 |

*Primary Examiner*—Harold Dixon

*Attorney, Agent, or Firm*—Fleit, Jacobson, Cohn & Price

[57] ABSTRACT

A rectifier housing for use with light bulbs to extend the life thereof. The housing includes a rigid, non-conductive base with a substantially centrally positioned rectifier element. A resilient, annular connector member is secured to one side of the housing to surround the rectifier, and includes an adhesive-coated upper face adapted to permit releasable attachment of the housing to the base of a light bulb.

11 Claims, 7 Drawing Figures

RECTIFIER HOUSING FOR USE WITH LIGHT BULBS

BACKGROUND OF THE INVENTION

This invention relates to a housing for rectifiers, and more particularly to an improved rectifier housing adapted to be releasably adhesively secured to the base of a light bulb.

The use of rectifier devices to extend the life of incandescent electric light bulbs is well known. In such devices a half-wave rectifier is inserted in the light bulb socket, between the socket center terminal and the tip contact of the typical threaded base type light bulb, in order to extend the life of the bulb by reducing the effective voltage applied to the bulb filament. The rectifier operates essentially to convert alternating current to pulsating direct current, the effective voltage level of which is lower than that of the alternating current source. By imposing a lower effective voltage upon the light bulb filament, the operating life thereof is substantially extended, in some instances enabling a bulb to operate for a period of 24 hours a day, seven days a week, for at least ten years.

Previous rectifier devices intended for use in connection with light bulbs have been retained in a flat, disc-type housing which is manually positioned within the lamp socket prior to the insertion of the bulb therein. If for some reason it is desired to remove the rectifier disc from a particular socket, it would normally be necessary to invert the socket to permit the disc to fall therefrom, a procedure which is particularly difficult when large or weighty lamp structures are involved. Additionally, the installation of such a rectifier disc in a socket which has its opening directed downwardly is particularly difficult because the rectifier disc must be balanced on the bulb tip contact or the socket temporarily inverted to permit the rectifier disc to be dropped therein prior to the installation of the bulb. That inversion procedure is impossible with ceiling fixtures without removing the socket, which is a cumbersome and time-consuming procedure.

It therefore is desirable to provide a rectifier having means to facilitate the installation of such a rectifier in a downwardly directed light bulb socket and to facilitate the removal of the rectifier from an upwardly extending light bulb socket without the necessity for requiring that a socket be inverted either for installation of the rectifier or for its removal therefrom.

There also is a need for a centering mechanism which ensures that the rectifier makes solid contact with the bulb and with the socket.

SUMMARY OF THE INVENTION

Briefly stated, in accordance with one aspect of the present invention, there is provided a rectifier housing which is adapted to be releasably secured to the base of a screw base light bulb. The housing includes a substantially rigid non-conductive base having an upper surface, a lower surface which is spaced from the upper surface, and a substantially centrally positioned rectifier element securely retained in the base. The rectifier element has an exposed cathode adjacent the upper face of the housing and an exposed anode adjacent the lower face. A resilient connector member is secured to the upper face of the base and extends outwardly from the exposed cathode. The connector member has a thickness greater than the space between the upper and lower faces of the base of the light bulb with which it is used, and includes an adhesive-coated upper surface which is spaced outwardly from the upper face of the base for releasably securing the housing to a screw base light bulb.

It is thus an object of the present invention to provide an improved rectifier housing which can be releasably attached to the base of a light bulb to facilitate its installation in a downwardly facing socket and to facilitate its removal from an upwardly facing socket.

It is another object of the present invention to provided a rectifier housing which is adaptable to screw base light bulbs with different tip contact lengths.

It is a further object of the present invention to provide a rectifier housing including protective means to prevent the inadvertent sidewise dislodgement of the connector member therefrom either during transit or in use.

DESCRIPTION OF THE PREFERRED EMBODIMENTS

Figure 1:
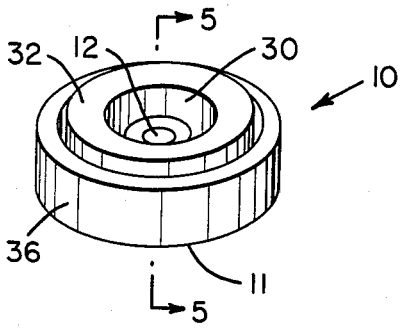
FIG. 1 is a perspective view of a rectifier housing in accordance with the present invention.
Figure 2:
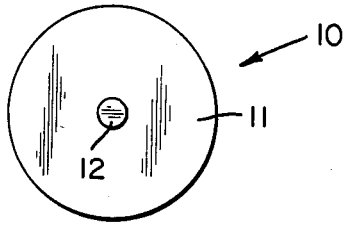
FIG. 2 is a bottom view of the rectifier housing shown in FIG. 1.
Figure 3:
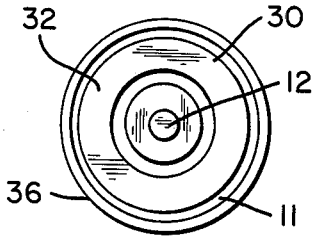
FIG. 3 is a top view of the rectifier housing shown in FIG. 1.

Referring now to the drawing, and particularly to FIGS. 1, 2, and 3 thereof, there is shown a rectifier housing 10 in accordance with the present invention. The housing has a substantially rigid base 11 of generally disc-like form, and includes a substantially centrally positioned rectifier element 12 securely retained therein. Base 11 can be formed from any suitable dielectric materials, with NORYL 4225, a modified polyphenylene oxide available from General Electric Co., preferred by reason of ease of manufacture and flame retardant properties, and base 11 preferably has a diameter slightly smaller than the bulb socket to permit quick insertion therein. Rectifier 12 can be a semiconductor diode, or the like, to provide half-wave rectification of alternating current into pulsating direct current having an average theoretical voltage level of 84. 85 volts, as compared with a 120 volt alternating current source. The "duty cycle" would thus be reduced from 120 "pulses" per second (60 plus and 60 minus) to 60 "pulses" per second (60 plus and 0 minus) or 60 minus and 0 plus, depending upon the orientation of the diode. An example of a suitable rectifier element is a 3 amp. diode designated Model No. PR4-D, manufactured by General Instrument Co., Hicksville, N.Y.

Figure 5:
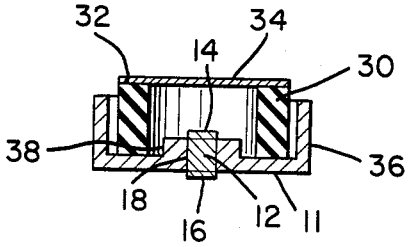
FIG. 5 is a cross-sectional view of the rectifier housing shown in FIG. 1 and taken along the line 5—5 thereof.
Figure 4:
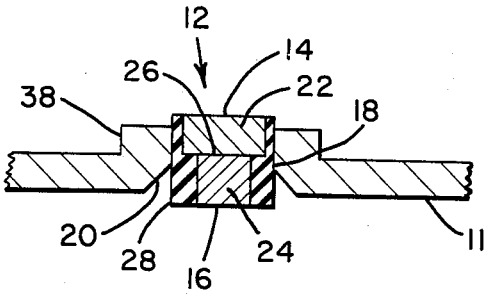
FIG. 4 is an enlarged fragmentary view of a portion of the housing showing the positioning of the rectifier therein.

As best seen in FIGS. 4 and 5, rectifier 12 can be in the general form of a flat wafer and includes an upper face 14 and a lower face 16. One of the faces 14,16 is the anode and the other face is the cathode. In each instance, the surfaces 14,16 of the cathode and anode are exposed so that they can make electrical contact with the center contact of a light bulb socket and the tip contact of a light bulb, respectively, as will hereinafter be described. Although the surfaces 14,16 can be coplanar with the respective upper and lower faces of base 11, it is preferred that they extend outwardly slightly beyond the respective adjacent surfaces to ensure positive contact with the contact elements with which each is adapted to be connected.

Referring now to FIG. 4, base 11 of housing 10 includes a substantially central positioned, circular aperture 18 to receive rectifier 12. Aperture 18 terminates in a chamfered edge 20. Rectifier 12 includes an upper disc-like portion 22 and a lower disc-like portion 24 adhered thereto at interface 26. Upper disc 22 has an outer diameter greater than that of lower disc 24, and the outer periphery of each disc is surrounded by a thin cylindrical sleeve 28 of flexible material, such as silicone rubber, or the like, so that the outer diameter of the rectifier and sleeve is uniform throughout its axial length and is slightly greater than that of aperture 18 in order to provide a snug fit when the rectifier is positioned in the aperture. Chamfered edge 20 facilitates the insertion of rectifier 12 into aperture 18 and also provides a space to receive any displaced rubber from sleeve 28 resulting from the compression of the sleeve because of the smaller diameter of aperture 18. Thus rectifier 12 can be retained in base 11 without the need for any adhesive.

Extending upwardly from base 11 is a resilient connector member 30 which, as illustrated, is of generally annular conformation and is positioned in surrounding relationship with rectifier 12. Connector member 30 is adhesively secured to the upper face of base 11 in nonremovable relationship therewith and includes an upper surface 32 having an adhesive coating applied thereto to permit attachment of housing 10 to the base of a light bulb. Preferably, the adhesive carried by upper surface 32 of connector member 30 permits releasable attachment of housing 10 to the base of the light bulb with which the device is intended to be used. Upper surface 32 of connector member 30 is preferably so configured that it substantially conforms to and adapts with the corresponding base surface of the light bulb. Additionally, a removable protective cover sheet 34 is applied to upper surface 32 to protect it from dirt and debris which might adhere thereto prior to installation of housing 10 on a light bulb. Cover sheet 34 can be in the form of a circular disc or it can be annular to permit rectifier 12 to be seen when the same is packaged.

Any suitable resilient material can be employed to form connector member 30, although if the material employed is relatively stiff and inflexible, the compressive force necessary to compress connector member 30 to insure contact of the bulb tip with rectifier 12 may be excessive. Consequently, it is preferred that the connector member be formed from a relatively flexible material in order to avoid the excessive compressive forces which would otherwise be required. Preferred materials for resilient connector member 17 include foam rubber, foam plastics, such as, for example, polyurethane foam, or other foamed or non-foamed materials having sufficient resilience and thermal stability. An example of a preferred material is a foam rubber manufactured by the 3M Company, Minneapolis, Minn., and designated by number 4008.

The adhesive applied to upper surface 32 of connector member 30 can be any suitable pressure-sensitive adhesive which will permit secure adhesion of housing 10 to the base of a light bulb, while also permitting removal therefrom without tearing or otherwise damaging connector member 30. It is intended that housing 10 can be removed from one light bulb and inserted upon the base of another, if desired, and thus it can be reused any number of times. Additionally, connector member 30 extends upwardly from base 11 a substantial distance, which is to some degree dependent upon the resilience of the material involved, but preferably is at least twice the thickness of the housing, taken in axial direction.

As best seen in FIG. 5, base 11 includes an upstanding annular sidewall 36 which extends upwardly from the upper face thereof in generally surrounding relationship with connector member 30. Sidewall 36 serves as a protective element to prevent unintended damage to connector member 30 prior to the application of housing 10 to a light bulb base. When present, upstanding sidewall 36 preferably has an axial height which is slightly less than that of connector member 30 in order to facilitate the removal of protective cover sheet 34 from upper surface 32 of connector member 30. Additionally, the upper face of base 11 can have an annular lip 38 surrounding aperture 18 in order to provide a base 11 of reduced thickness to reduce the quantity of base material required, and thereby to minimize the cost of the device.

Figure 6:
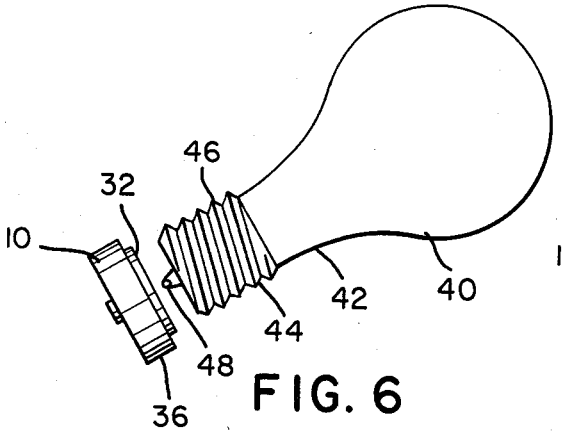
FIG. 6 is a side view of a screw base light bulb showing the rectifier housing of the present invention in spaced relationship thereto and prior to attachment thereto.
Figure 7:
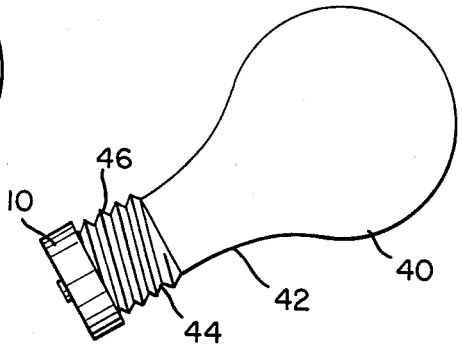
FIG. 7 is a side view of a screw base light bulb with a rectifier housing in accordance with the present invention secured to the base thereof.

In operation, the typical incandescent light bulb illustrated in FIGS. 6 and 7 includes a bulb portion 40, a stem portion 42, and a base portion 44. Base 44 is generally made of metallic material to serve as one of the electrical contacts for the bulb filament (not shown), and includes an external thread 46 which is adapted to mate with and engage a similarly configured internal thread within a bulb socket (not shown). Base 44 includes an outwardly extending tip contact 48, which is surrounded by an insulating material (not shown) to separate tip contact 48 electrically from base 44 in order to prevent a short circuit.

As shown in FIG. 6, housing 10 of the present invention is positioned so that sidewall 36 is directed to exposed tip contact 48, protective cover sheet 34 is removed from connector member 30, and the latter is then pressed into engagement with the end of the light bulb base 44 so that tip contact 48 contacts rectifier 12 and upper surface 32 of connector member 30 is in adhesive contact with the area of base 44 which surrounds tip contact 48. FIG. 7 shows housing 10 in position on bulb 40. When so applied, housing 10 is securely positioned on base 44, and the bulb can then be screwed into an associated socket, whether the socket is arranged so that the opening faces upwardly, or whether the socket is arranged so that the opening faces downwardly. Bulb 40 is securely threaded into the socket until resistance to further turning is felt, which is indicative of contact between tip contact 48 of bulb 40, and upper face 14 of rectifier 12, and contact between lower face 16 of rectifier 12 with a corresponding center contact of the socket (not shown). Housing 10 can be left in position for as long a period as is desired, with the result that substantial savings in electrical energy are provided, and the life of the light bulb is significantly extended.

If it is desired to utilize the light bulb without the energy saving rectifier of the present invention, the bulb need merely be unscrewed from the socket, whether the socket be oriented with its opening facing upwardly or oriented with its opening facing downwardly, the light bulb removed therefrom, and the rectifier housing of the present invention is readily accessible and can easily be removed from the light bulb by carefully lifting it therefrom to release the pressure sensitive adhesive from the light bulb base. Thereupon the light bulb can be reinstalled in the socket and the rectifier housing of the present invention can be utilized in conjunction with another light bulb in another socket, if desired.

It thus can be seen that the rectifier housing of the present invention provides a substantial improvement over previous devices of the same or similar character in that it permits quick releasable attachment of the rectifier housing to a light bulb to permit rapid installation thereof in a light bulb socket, whether the socket be oriented so that its opening is directed upwardly or whether it be oriented so that its opening is directed downwardly. Similarly, upon removal of the light bulb the rectifier housing remains attached thereto until removed by the user, thereby avoiding the necessity for inverting an upwardly facing light socket, one positioned in a lamp, for example, in order to install or remove the rectifier.

While particular embodiments of the present invention have been illustrated and described, it will be apparent to those skilled in the art that various changes and modifications can be made without departing from the spirit and scope of the present invention, and it is intended to cover in the appended claims all such changes and modifications that fall within the scope of the present invention.

What is claimed is:

1. A rectifier housing adapted to be releasably secured to the base of a screw base light bulb, said housing comprising:

a substantially rigid non-conductive base having an upper surface and a lower surface spaced therefrom and a substantially centrally positioned aperture, a rectifier element securely retained in said aperture, said rectifier element having an exposed face adjacent one of said base surfaces and an exposed face adjacent the other of said base surfaces and including an outer cylindrical sleeve of flexible material; and a resilient connector member secured to said upper surface and spaced radially outwardly from said rectifier element, said connector member having a thickness greater than the spacing between said upper surface and said lower surface of said base and having an adhesive-coated upper face spaced outwardly from said base for releasably securing said housing to a screw base light bulb.

2. The rectifier housing of claim 1, wherein said connector member is annular and is in surrounding relationship to said rectifier.

3. The rectifier housing of claim 2, including a releasable protective cover sheet positioned on said adhesive-coated upper face of said connector member to prevent the contact of dirt and debris with said adhesive surface prior to use.

4. The rectifier housing of claim 1, wherein said flexible material is silicone rubber.

5. The rectifier housing of claim 1, wherein said rectifier extends outwardly beyond the surface of said base.

6. The rectifier housing of claim 1, wherein said resilient connector member is a flexible, foamed material to permit substantial deflection thereof under low loads.

7. A rectifier housing adapted to be releasably secured to the base of a screw base light bulb, said housing comprising:

a substantially rigid non-conductive base having an upper surface and a lower surface spaced therefrom and a substantially centrally positioned aperture, a rectifier element securely retained in said aperture, said rectifier element having an exposed face adjacent one of said base surfaces and an exposed face adjacent the other of said base surfaces;

a resilient annular connector member secured to said upper surface and spaced radially outwardly from and in surrounding relationship to said rectifier element, said connector member having a thickness greater than the spacing between said upper surface and said lower surface of said base and having an adhesive-coated upper face spaced outwardly from said base for releasably securing said housing to a screw base light bulb, said base including an upstanding wall extending outwardly from said base for a distance less than the thickness of said connector member, said upstanding wall being annular and in surrounding relationship with said connector member; and a releasable protective cover sheet positioned on said adhesive-coated upper face of said connector member to prevent the contact of dirt and debris with said adhesive-coated upper face prior to use.

8. The rectifier housing of claim 7, wherein said upper face of said base includes an annular lip surrounding said rectifier.

9. The rectifier housing of claim 7, wherein said rectifier extends outwardly beyond the surface of said base.

10. The rectifier housing of claim 7, wherein said resilient connector member is a flexible, foamed material to permit substantial deflection thereof under low loads.

11. The rectifier housing of claim 10, wherein said resilient connector member is a foamed plastic.

* * * * *